US008997544B2

(12) United States Patent
Abt et al.

(10) Patent No.: US 8,997,544 B2
(45) Date of Patent: Apr. 7, 2015

(54) FORMING DEVICE

(75) Inventors: Wilfried Abt, Rechberghausen (DE); Helmut Aichele, Goppingen (DE); Carsten Brechling, Ulm (DE)

(73) Assignee: Hinterkopf GmbH, Eislingen/Fils (DE)

( * ) Notice: Subject to any disclaimer, the term of this patent is extended or adjusted under 35 U.S.C. 154(b) by 381 days.

(21) Appl. No.: 13/040,691

(22) Filed: Mar. 4, 2011

(65) Prior Publication Data

US 2011/0214473 A1 Sep. 8, 2011

(30) Foreign Application Priority Data

Mar. 5, 2010 (EP) ..... 10002282

(51) Int. Cl.

| | |
|---|---|
| ***B21J 7/12*** | (2006.01) |
| ***B21D 51/26*** | (2006.01) |
| ***B21D 22/02*** | (2006.01) |
| ***B30B 1/26*** | (2006.01) |
| ***B30B 1/28*** | (2006.01) |
| ***B30B 15/04*** | (2006.01) |

(52) U.S. Cl.

CPC ..... *B21D 51/2615* (2013.01); *B21D 22/02* (2013.01); *B30B 1/263* (2013.01); *B30B 1/266* (2013.01); *B30B 1/28* (2013.01); *B30B 15/041* (2013.01)

(58) Field of Classification Search

USPC ..... 413/50, 78, 70, 71; 72/431, 449, 450, 72/452.4, 452.2, 452.1

See application file for complete search history.

(56) References Cited

U.S. PATENT DOCUMENTS

| | | | | |
|---|---|---|---|---|
| 3,270,544 | A * | 9/1966 | Maeder et al. | 72/346 |
| 4,987,794 | A * | 1/1991 | Brunner et al. | 74/570.21 |
| 7,434,442 | B2 * | 10/2008 | Gombas | 72/449 |
| 7,434,505 | B2 * | 10/2008 | Suzuki et al. | 100/43 |
| 2003/0041643 | A1 | 3/2003 | Tang et al. | |
| 2008/0069665 | A1 | 3/2008 | Hanafusa et al. | |

FOREIGN PATENT DOCUMENTS

| | | |
|---|---|---|
| DE | 1777297 | 7/1971 |
| DE | 9200550 | 5/1993 |
| DE | 4307535 | 9/1994 |
| EP | 0275369 | 7/1988 |
| EP | 1518667 | 3/2005 |
| EP | 2123373 | 11/2009 |
| WO | WO0158618 | 8/2001 |
| WO | WO2004058597 | 7/2004 |

* cited by examiner

*Primary Examiner* — Shelley Self
*Assistant Examiner* — Matthew G Katcoff
(74) *Attorney, Agent, or Firm* — Hoffmann & Baron, LLP

(57) ABSTRACT

A forming device for cup-shaped hollow bodies having a machine frame, a drive device, a workpiece rotary table for accommodating hollow bodies and a tool holder for accommodating processing tools, wherein the workpiece rotary table and the tool holder face one another and can be turned about a rotational axis in relation to one another and can be linearly moved in relation to one another along the rotational axis, and wherein the drive device comprises first drive means for providing a rotary step movement and second drive means for providing a cyclical linear movement between workpiece rotary table and tool holder to enable the hollow bodies to be formed by means of the processing tools in a plurality of consecutive processing steps. The second drive means has a stroke adjustment arrangement which is designed for adjusting a working stroke of the cyclical linear movement as a function of a control signal of a control device and/or for continuously variably adjusting the working stroke.

14 Claims, 2 Drawing Sheets

FORMING DEVICE

BACKGROUND OF THE INVENTION

The invention relates to a forming device for cup-shaped hollow bodies having a machine frame, a drive device, a workpiece rotary table for accommodating hollow bodies and a tool holder for accommodating processing tools, wherein workpiece rotary table and tool holder face one another and can be turned about a rotational axis in relation to one another and can be linearly moved in relation to one another along the rotational axis, and wherein the drive device comprises first drive means for providing a rotary step movement and second drive means for providing a cyclical linear movement between workpiece rotary table and tool holder, in order to enable the hollow bodies to be formed by means of the processing tools in a plurality of consecutive processing steps. The invention also relates to a method for setting a phase position between first drive means which are designed for providing a rotary step movement and second drive means which are designed for providing a cyclical linear movement for a forming device for cup-shaped hollow bodies.

A forming machine is known from EP 0 275 369 A2, with which cup-shaped hollow bodies made of metal, in particular aluminium, can be formed in certain areas, in particular drawn in locally, from an essentially cylinder sleeve shaped initial state, so that, for example, a closing cap or an atomizer valve can be fitted in a sealing manner in the area of the opening. The known forming machine has a machine frame, on which a supporting tube is formed. A workpiece rotary table is pivot-mounted on an outer surface of the supporting tube. A linearly movable guide tube is accommodated in a recess bounded by the supporting tube, to the end section of which linearly movable guide tube the tool holder is attached. A drive device is accommodated in the machine frame, which drive device is designed to produce an intermittent rotary movement of the workpiece rotary table and to produce an oscillating linear movement of the guide tube and the tool holder connected to it. By means of the linear movement, the tools provided on the tool holder, in particular forming tools, can be brought into engagement with the hollow bodies held on the workpiece rotary table, in order to locally process them, particularly in order to plastically deform them. By means of the intermittent rotary movement of the workpiece rotary table, the hollow bodies can be brought into contact with the tools, attached to the tool holder table, in serial order so as to form the hollow bodies step by step from a starting geometry to a target geometry.

SUMMARY OF THE INVENTION

The object of the invention consists in providing a forming device which can be simply adapted to the hollow bodies to be processed.

For a forming device of the kind mentioned at the outset, this object is achieved with the features of Claim 1. In doing so, provision is made for the second drive means to comprise a stroke adjustment arrangement which is designed for adjusting a working stroke of the cyclical linear movement as a function of a control signal of a control device and/or for continuously variably adjusting the working stroke.

The hollow bodies to be processed by the forming device can differ from one another with regard to their outer geometry and with regard to the size and location of the areas to be formed on the hollow body. For example, a first embodiment of a hollow body can have a thin, elongated shape and is intended for processing both in the container opening area and in the area of the side walls to close to the bottom area. A second embodiment of a hollow body can have a compact form and only require processing in the container opening area. According to the design of the hollow body and the processing steps intended for the hollow body, a bigger or smaller working stroke for the cyclical linear movement is correspondingly required. For example, the processing tools for processing close to the bottom area of a thin and elongated hollow body are driven deep into the hollow body, for which a big working stroke of the second driving means is required. In order to make sure, when executing the working stroke, that a presettable acceleration of the processing tools is not exceeded during the cyclical linear movement, provision can be made for the frequency of the cyclical linear movement to be adapted to the working stroke. In this way, a lower frequency of the cyclical linear movement can be chosen for a big working stroke than is the case for a small working stroke. In order to always be able to carry out processing of the hollow bodies with the highest possible frequency for the cyclical linear movement, it is advantageous to be able to adapt the working stroke in each case to the requirements of the processing operation. It can thereby be ensured that the tool rotary table and the processing tools attached to it are always moved below the presettable maximum acceleration. This is made possible by the stroke adjustment arrangement according to the invention which is connected to a control device, preferably designed as a machine control system, from which a control signal is sent to the stroke adjustment arrangement for the desired working stroke. The working stroke can be set during operation of the forming device, but preferably the working stroke is set in the idle state of the forming device. Particularly preferably, the working stroke can be set fully automatically without manual intervention by an operator. In fact, the control device is designed in such a way that, when a new value is input for the working stroke, it correspondingly actuates the stroke adjustment arrangement, or that a processing program and/or setting program running in the control device can cause working stroke values to be set automatically or in a self-actuating manner. In addition or alternatively, the working stroke can be continuously variably adjusted, so that the working stroke can be precisely adapted to the requirements of the processing operation for the hollow bodies.

Advantageous further embodiments of the invention are the subject-matter of the sub-claims.

It is beneficial if the first drive means and the second drive means are kinematically forcibly coupled and for the drive device to comprise a first coupling device for intermittently disconnecting the forced coupling between the first drive means and the second drive means. The kinematic forced coupling of the two drive means ensures that the rotary step movement of the first drive means and the cyclical linear movement of the second drive means always take place synchronously in relation to one another. Preferably, the kinematic forced coupling of the two drive means is ensured by a gear device, for example a lever gear, a wheel gear, a belt drive or a combination thereof. A phase shift between the rotary step movement and the cyclical linear movement can occur when setting the working stroke for the cyclical linear movement by means of the stroke adjustment arrangement. This phase shift can, for example, be expressed to the effect that before setting the working stroke the cyclical linear movement only takes place if no rotary step movement takes place, while after the working stroke has been set a temporal overlap between rotary step movement and cyclical linear movement exists. According to the configuration of the processing operation for the hollow bodies and the processing tools provided for this purpose, the case can arise where the processing tools are still engaged with the hollow bodies when the next rotary step movement is initiated. Since in this connection the hollow bodies and/or the forming device can be damaged, it is advantageous if a phase shift between rotary step movement and cyclical linear movement is avoided. This can, in particular, be ensured by the first coupling device which before setting the working stroke is brought out of a coupled state, in which a forced coupling exists between first and second drive means, into a decoupled state, in which the forced coupling between the drive means is suspended. Consequently, relative movements which the second drive means carry out when setting the working stroke do not have an effect on the first drive means. After setting the working stroke, the first coupling device is activated again, so that the desired forced coupling of the two drive means is restored.

Preferably, the drive device comprises setting means which are designed for setting a phase position between the rotary step movement and the cyclical linear movement. As a function of the processing of hollow bodies to be carried out, it can be advantageous for example for optimising the frequency for the cyclical linear movement to provide a presettable temporal overlap between the cyclical linear movement and the rotary step movement. In order to enable the phase position of these two movements in relation to one another to be adapted, setting means according to the invention are provided which enable a targeted phase change to be made between the cyclical linear movement and the rotary step movement. Preferably, the phase position is set when the first coupling device is open and therefore without a forced coupling between the first and second drive means. With a corresponding design of the drive means, the phase position can also be changed without suspending the forced coupling between the drive means.

With one embodiment of the invention, provision is made for the setting means to be coupled to the control device, in order to ensure that the phase position is set, in particular continuously variably, as a function of the control signal of the control device, which control signal is supplied to the stroke adjustment arrangement. The phase position can hereby be automatically set and a direct, mechanical intervention in the forming device by the operator can be dispensed with. This simplifies operation of the forming device, since the phase position can be input via an operator interface of the control device or, where applicable, can be determined in an automated manner in the control device as a function of parameters such as the working stroke and/or the geometry of the hollow bodies to be processed. In addition, as a result the process reliability for the processing operation is increased, since unwanted or critical operating states for the forming device can be avoided. Preferably, the phase position can be set continuously variably, in order to enable the hollow bodies to be processed as precisely as possible.

In a further embodiment of the invention, provision is made for the second drive means to comprise a crank gear which is kinematically coupled to a drive motor, which is designed for providing a rotational movement, and to the first drive means, and for the coupling device to be arranged between the crank gear and the first drive means. The crank gear is used to convert the rotational movement of the drive motor, which, in particular, can be an electric motor, into the cyclical linear movement which is conveyed to the tool holder and/or the workpiece rotary table. Kinematic coupling of the crank gear to the first driving means favours keeping narrow tolerances between the rotary step movement and the cyclical linear movement. Accordingly, the first coupling device is arranged between the crank gear and the first drive means.

It is advantageous if the crank gear comprises a double eccentric arrangement having a first eccentric and a second eccentric encompassing the first eccentric, which double eccentric arrangement serves as a stroke adjustment arrangement, wherein a connecting rod, which is designed for kinematically coupling the workpiece rotary table or the tool holder to the crank gear, acts on one of the eccentrics. By means of the double eccentric arrangement, it is possible for the rotational movement of the drive motor to be converted into the cyclical linear movement of the tool holder and/or of the workpiece rotary table with little backlash, in particular free from backlash. In addition, the double eccentric arrangement allows the desired stroke adjustment to be made by relative, in particular continuously variable, turning of the two interlocking eccentrics. With a suitable design of the two eccentrics, the same positional tolerance always applies for the crank gear irrespective of the chosen working stroke. Any possibly provided compensation of the positional tolerance is thereby made easier. The connecting rod acts on one of the two eccentrics and converts the circular movement of the double eccentric arrangement into a linear movement, for example of a coupling slide. The coupling slide is preferably guided linearly on the machine frame and is coupled to the tool holder and/or the workpiece rotary table, in order to transfer cyclical linear movement.

In a further embodiment of the invention, provision is made for the setting means to comprise a locking device which can be adjusted between a release position and an engagement position for fixing an eccentric of the double eccentric arrangement and which can be actuated by the control device. The locking device allows the relative turning of one eccentric of the double eccentric arrangement with respect to the other eccentric of the double eccentric arrangement, in order to enable the working stroke to be set in the desired manner. The locking device is preferably designed to engage with the eccentric in a form-fitting manner and prevents this eccentric from moving, in particular from rotating when setting the working stroke.

It is beneficial if a sensor device for determining the respective rotatory position, which is connected to the control device, is assigned to the crank gear and/or the drive motor and/or at least one eccentric of the double eccentric arrangement and/or the first drive means. By means of the sensor device, which can, for example, be an absolute angle sensor or an incremental angle of rotation sensor and which in particular is also referred to as an encoder, the rotatory position of the respective scanned component can be determined and transmitted to the control device in the form of a, preferably electrical, sensor signal. For example, by comparing the rotatory position of the crank gear and the rotatory position of the first drive means, the phase position of the rotary step movement with respect to the cyclical linear movement can be determined, so that a correction of the phase position can be made in a subsequent step by means of the setting means.

It is advantageous if a look-up table is stored in the control device, in which a correction value for the phase position between the rotary step movement and the cyclical linear movement is assigned to each position of the double eccentric arrangement. The position of the double eccentric arrangement derives from the relative position of the two eccentrics, which can, for example, be determined by sensor devices assigned in each case. Starting from this double eccentric arrangement position, the actual phase position between rotary step movement and cyclical linear movement can be determined by means of the look-up table stored in the control device or a corresponding calculation algorithm and compared with a nominal phase position for the corresponding position of the double eccentric arrangement. The desired phase position can then be set in a subsequent step.

In a further embodiment of the invention, provision is made for the setting means to be formed by the drive motor, the locking device and the control device. A simple forming device configuration is hereby advantageously achieved. The drive motor is used, for example, to cause the two eccentrics of the double eccentric arrangement to turn relative to one another. This can, for example be achieved by one of the eccentrics being non-rotatably locked by means of the locking device and the other eccentric being relatively turned by the drive motor by conveying a rotary movement to the crank gear, in order to cause the working stroke to be, in particular continuously variably, set. The control device is preferably designed in such a way that it can actuate the drive motor to carry out rotary movements in the range of fractions of a revolution, for example with an angular resolution of 1 degree. Due to the reduction between the rotational movement, provided by the drive motor, and the rotational movement of the double eccentric arrangement, this can consequently be set with an angular resolution which is considerably smaller than the angular resolution for actuating the drive motor, so that the working stroke can be practically continuously variably adjusted.

Preferably, the crank gear comprises a gear wheel which is coupled to the drive motor and to which the first eccentric is non-rotatably connected, wherein the connecting rod acts on the second eccentric and a second coupling device is designed for releasable forced coupling of the first eccentric to the second eccentric. The gear wheel can, for example, be pivot-mounted on a bearing support by means of bearing journals. Preferably, the gear wheel has circumferential external teeth with which a drive pinion meshes which is coupled directly or via a reduction stage, for example via a flywheel gear, to the drive motor. The first eccentric is non-rotatably attached to the gear wheel, preferably integrally formed onto it. The eccentric serves to add a translational component to a pure rotational movement of the gear wheel. The first eccentric is encompassed by the second eccentric, which is rotatably mounted on the first eccentric and, according to the relative position with respect to the first eccentric, enlarges, leaves unchanged or reduces the translational component of the first eccentric. A second coupling device is provided for fixing the second eccentric on the first eccentric, which in a coupling position ensures a forced coupling between the first and the second eccentric and in a release position enables the two eccentrics to turn relatively to one another. The connecting rod is rotatably mounted on the second eccentric and preferably a connecting eye of the connecting rod encompasses the second eccentric and as a result enables the combined, superimposed rotary and linear movements to be conveyed, for example, to a coupling slide.

Preferably, the locking device is designed for engaging with the second eccentric. The second eccentric can thus be locked by means of the locking device for setting the working stroke. Then, the second coupling device is actuated, in order to release the forced coupling between the two eccentrics. In a subsequent step, the drive motor is actuated, which turns the gear wheel and the first eccentric, which is non-rotatably incorporated with it, relative to the locked, in particular blocked, second eccentric, until the desired relative position of the two eccentrics is obtained and thus the working stroke aimed for is set. The second coupling device is subsequently re-coupled and the locking device is disengaged, in order to ensure that the gear wheel can rotate freely with the two eccentrics which are now non-rotatably connected to one another again.

In one embodiment of the invention, provision is made for actuating means to be assigned to the coupling device, which are designed for actuating by the control device and which optionally enable the coupling device to be opened or closed, in particular as a function of an operating state of the drive device. The coupling device can be actuated in an automated, power-operated way by means of the actuating means. Preferably, the actuating means are electrically or fluidically operated, whereby a simple and compact design for the actuating means can be obtained.

It is beneficial if the coupling device is designed as a clamping set having at least two clamping rings, wherein adjoining clamping rings have cone surfaces designed corresponding to one another. A clamping set enables the reliable, frictionally engaged and, regarding the relative rotational positions, optional fixing of the components which are to be non-rotatably connected to one another, for example of the second eccentric to the first eccentric. To that end, the clamping set comprises at least two clamping rings which in each case have cone surfaces corresponding to one another. The cone surfaces taper in the direction of a rotational symmetry axis of the clamping rings, so that by applying a clamping force in the direction of the rotational symmetry axis radial forces, directed radially inwards and/or outwards, can be exerted by the clamping rings onto adjoining components, for example in order to fix a bush to a shaft. The rotationally symmetrical design of the cone surfaces means that the opposing clamping rings can be brought into any angular position in relation to one another, so that a rotatory relative movement with an angle of 1 degree or less between the adjoining components, for example the two eccentrics of the double eccentric arrangement, is also possible.

For a method for setting a phase position between first drive means which are designed for providing a rotary step movement and second drive means which are designed for providing a cyclical linear movement for a forming device for cup-shaped hollow bodies, the object of the invention is achieved with the features of Claim 15. In this connection, provision is made for, between the first and the second drive means, a first coupling device to be arranged for intermittently suspending a forced coupling between the drive means and for the second drive means to be designed as a crank gear having a double eccentric arrangement for adjusting the stroke of the cyclical linear movement. Furthermore, a drive motor is provided which is coupled to the crank gear. The method comprises the steps of: detecting a passive state of the drive device, releasing the first coupling device for suspending the forced coupling between the first and second drive means, carrying out the stroke adjustment by means of the double eccentric arrangement, setting the phase position between the first and second drive means and closing the first coupling device to restore the forced coupling between the first and second drive means. Preferably, the control device, the drive motor and the double eccentric arrangement are designed in such a way that the working stroke and/or the phase position can be continuously variably and/or automatically set, in particular without the mechanical intervention of an operator.

BRIEF DESCRIPTION OF THE DRAWINGS

An advantageous embodiment of the invention is illustrated in the drawings and in this connection.

DETAILED DESCRIPTION OF THE PREFERRED EMBODIMENTS

Figure 1:
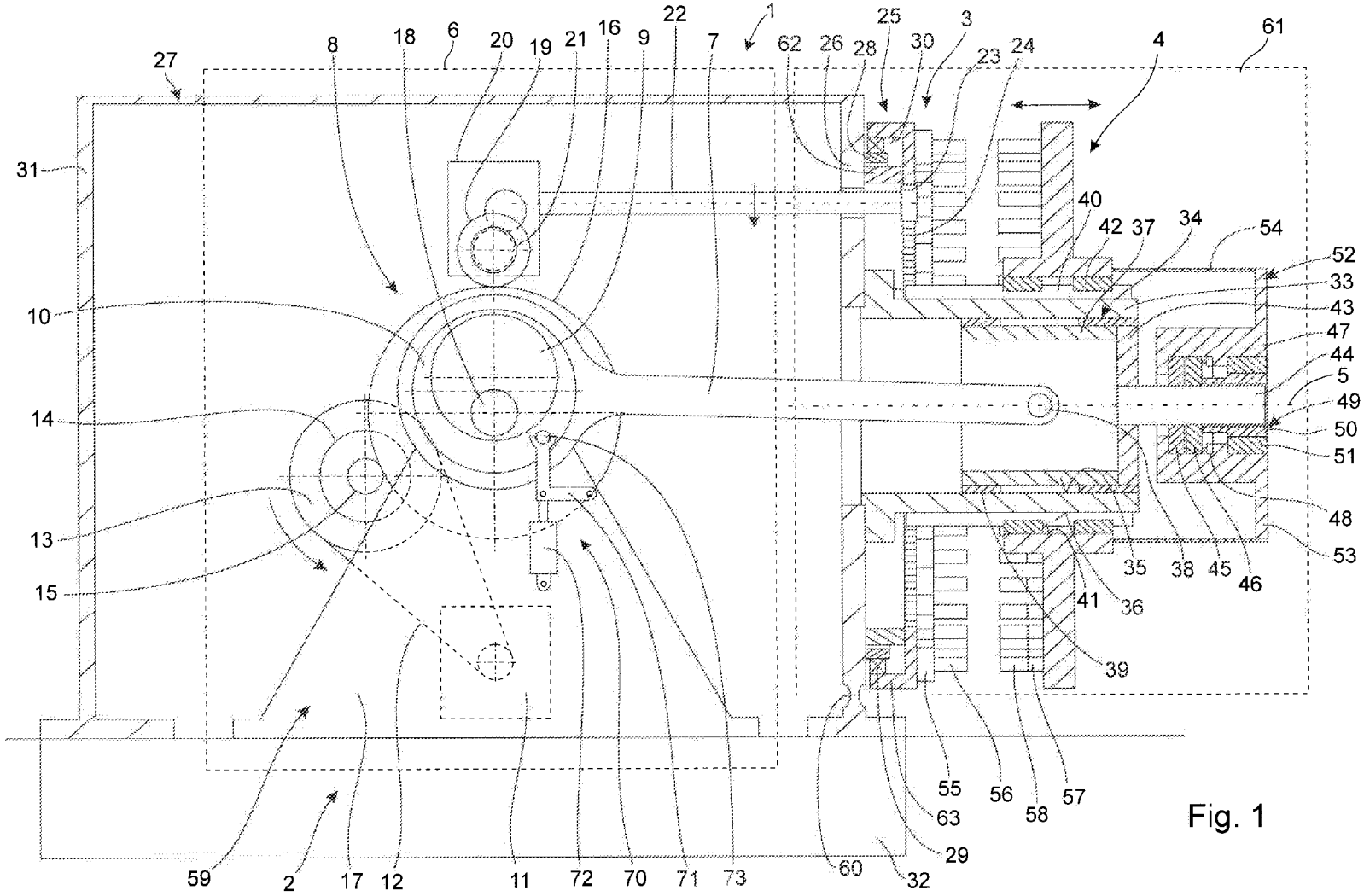
FIG. 1 shows a planar, schematic cross-sectional view through a forming device.

A forming device 1 illustrated in FIG. 1, which can, in particular, be used for forming cup-shaped hollow bodies, comprises a machine frame 2 on which a workpiece rotary table 3 and a tool holder 4 are arranged. In the illustrated embodiment of the forming device 1, the workpiece rotary table 3 is rotatably attached to the machine frame 2, while the tool holder 4 is, by way of example, accommodated on the machine frame 2, so that it can move linearly. The workpiece rotary table 3 is thus rotatably mounted about a rotational axis 5 with respect to the machine frame 2 and the tool holder 4. The tool holder 4 can be moved linearly along the rotational axis 5 with respect to the machine frame 2 and the workpiece rotary table 3.

The forming device 1 furthermore comprises a drive device 6 which is designed to provide an intermittent rotational movement or rotary step movement and to provide a cyclically oscillating linear movement. In the present case, the drive device 6 is designed to provide the rotary step movement to the workpiece rotary table 3 and to provide the cyclically oscillating linear movement to the tool holder 4.

The drive device 6 comprises, among other things, a double eccentric arrangement 8. The double eccentric arrangement 8, which comprises an inner eccentric 9, which is also referred to as an eccentric shaft, and an outer eccentric 10, which is also referred to as an eccentric bush, serves as a crank gear, which can be adjusted with respect to the crank stroke, for providing a circular rotation for a connecting eye (not specified further) of a connecting rod 7.

The forces required for driving the connecting rod 7 are provided, for example, by a drive motor 11 designed as an electric motor, which is coupled to a flywheel 13 via a belt drive 12 which is designed, by way of example, as a V-ribbed belt. The flywheel 13 can be connected in a power-transmitting way to a drive pinion 15 via a flywheel coupling 14 which can be coupled when the forming device 1 is in operation. The drive pinion 15 meshes with a main toothed wheel 16 which is accommodated pivot-mounted on two supporting side walls 17, of which only one can be seen in FIG. 1 due to the cross-sectional view. Two bearing journals 18, in mirror-image arrangement, preferably in each case integrally formed, and, by way of example, cylindrically designed, are attached to the main toothed wheel 16. These bearing journals 18 are arranged concentrically to the main toothed wheel 16 and engage, in a way which is not illustrated, with a bearing in each case associated with the supporting side wall 17, and are used for rotationally mounting the main toothed wheel 16. In addition, the inner eccentric 9 is immovably attached to the main toothed wheel 16, while the outer eccentric 10 is adjustably mounted on the main toothed wheel 16, in order to be able to set the crank stroke of the double eccentric arrangement 8 for the connecting rod 7.

To set the maximum stroke, the outer eccentric 10 can be decoupled from the inner eccentric 9 by means of a coupling, which is not illustrated further, and to set the stroke can be turned about a pivot axis running perpendicularly to the representation plane, preferably continuously variably, relative to the inner eccentric 9 by means of a drive device which is also not illustrated. Then, the coupling is closed again, so that the two eccentrics 9 and 10 are coupled to one another again in a power-transmitting way.

Also located on the main toothed wheel 16 is an output toothed wheel 19 in permanent engagement, which can be connected in a power-transmitting way to an indexing unit 20 via an indexing unit coupling 21 which can be switched when the forming device 1 is in operation. The indexing unit 20 converts the continuous rotary movement of the output toothed wheel 19 into a discontinuous, intermittent rotary step movement which is transferred via an indexing shaft 22 and an indexing pinion 23 to the workpiece rotary table 3. By way of example, an internal toothing 24 is formed on the workpiece rotary table 3, with which the indexing pinion 23 engages, in order to transfer the rotary step movement of the indexing unit 20 to the workpiece rotary table 3 which then performs the rotary step movement about the rotational axis 5. Alternatively, instead of the indexing unit 20, a servo drive can be used which enables electrically controlled rotary step movement.

By way of example, the workpiece rotary table 3 is pivot-mounted on a support plate 26 by means of a rotational bearing 25. The support plate 26 is part of a first machine frame section which also comprises a support frame 31. The support frame 31 in particular has the task of dispersing the turning moments, which by means of the weight forces of the components attached to the support plate 26 and further described below act on the support plate 26, into a base plate 32.

The rotational bearing 25 comprises, for example, a preferably annular bearing ring 28, attached to the support plate 26, which on a circumferential outer surface has a contact area for a plurality of schematically illustrated rolling elements 29. The rolling elements 29 are arranged between the bearing ring 28 and a bearing area 30, which is opposite the bearing ring 28 and is formed on the workpiece rotary table 3, by way of example, as a circumferential collar 63, and are held in position by a cage which is not illustrated further. They form together with the bearing ring 28 and circumferential collar 63 a radial bearing which ensures a low-friction and, in particular with regard to the rotational axis 5 and the tool holder 4, high-precision rotary movement of the workpiece rotary table 3. Processing forces which act on the workpiece rotary table 3 in the direction of the rotational axis 5 are supported, for example, by an annular slide bearing ring 62 which abuts flat on the surface of the workpiece rotary table 3. Preferably, the slide bearing ring 62 and the surface of the workpiece rotary table 3 located opposite are provided with lubricant from a lubricant circulation system, which is not illustrated further, supplying lubricant intermittently or continuously.

A supporting tube 33 is attached to a surface of the support plate 26 opposite the drive device 6 and spaced apart from the rotational bearing 25, which supporting tube 33, by way of example, serves for supporting and linearly mounting the tool holder 4. The supporting tube 3 in a cross-sectional plane, which is not illustrated, aligned perpendicularly to the rotational axis 5, has, by way of example, an annular cross-section. A cylindrical inner surface 35 of the supporting tube 33 serves as a slide bearing area for a coupling slide 34 which is coupled to the connecting rod 7 and is used to convert the combined rotary and linear movement of the connecting rod 7 into a linear movement.

The coupling slide 34 comprises, by way of example, a tubular base body 37, to which a bearing pin 38 is attached for pivot-mounting the connecting rod 7. A plurality of radially external, preferably annular, sliding pieces 39, made of slide bearing bronze for example, are arranged on the base body 37, which sliding pieces 39 are designed for sliding movement on the inner surface 35 of the supporting tube 33 which, by way of example, is manufactured from metal.

A plurality of bearing bars 40 extended parallel to the rotational axis 5 are attached to an outer surface 36 of the supporting tube 33, which bearing bars 40 serve as linear guide elements for the tool holder 4. Preferably, the bearing bars 40 are arranged in the same division of an angle about the rotational axis 5, for example in a 120 degree division or a 90 degree division.

For linearly guiding the tool holder 4, linear guides 42 are, in addition, attached to a radially internal inner surface 41 of the tool holder 4 corresponding to the bearing bars 40 and also referred to as ball roller shoes, which linear guides 42 in each case in a U-shape encompass the bearing bars 40. The linear guides 42 can, for example, be designed as a linear guidance system with re-circulating linear ball bearings, in which a plurality of cylindrical or spherical rolling elements are accommodated in a guideway and make a linear relative movement possible with respect to the respective bearing bar 40. Preferably, the linear guides 42 are clamped by a clamping means, which is not illustrated further, in the radial direction and/or in the circumferential direction of the supporting tube 33 against one another, whereby linear mounting of the tool holder 4 with little backlash, in particular free from backlash, with respect to the supporting tube 33 can be achieved. Due to the linear guides 42, the tool holder 4 is non-rotatably accommodated on the supporting tube 33.

An end plate 43 is attached to the base body 37 of the coupling slide 34 on the face side turned away from the connecting rod 7, which end plate 43 holds a threaded spindle 44. The threaded spindle 44 extends, for example, parallel, in particular concentrically, to the rotational axis 5. Two spindle nuts 45, 46, arranged spaced apart from one another along the rotational axis 5, engage with the outer thread, which is not illustrated further, of the threaded spindle 44. The two spindle nuts 45, 46 are connected to one another in a non-rotatable and linearly movable manner. A linear regulating device 48, which is preferably hydraulically actuatable, and a servomotor 49 are assigned to the second spindle nut 46.

The task of the servomotor 49, which is preferably designed as a torque motor and comprises a rotor 50, which is coupled to the second spindle nut 46 and pivot-mounted, and a stator 51, which is non-rotatably accommodated in a carrier 52, consists in moving the two spindle nuts 45, 46 by rotation along the threaded spindle 44 and in this way enabling an adjustment of an initial position of the tool holder 4 along the threaded spindle 44 to be made.

The task of the linear regulating device 48, which can exert a force in the direction of the rotational axis 5 onto the second spindle nut 46, consists in clamping the second spindle nut 46 with respect to the first spindle nut 45 and thereby enabling power transmission free from backlash between the threaded spindle 44 and the carrier 52, in which the spindle nuts 45 and 46 are immovably and rotatably accommodated.

The carrier 52 is, by way of example, designed as an essentially rotationally symmetrical body and has a circumferential flange 53, to which a tubular coupling means 54 is attached which is designed to connect in a power-transmitting way to the tool holder 4. The flange 53 and the coupling means 54 are dimensioned in such a way that they are slightly elastically deformed due to the forces transferred from the tool holder 4 to the workpiece rotary table 3 and thereby at least partly accommodate any tilting of the coupling slide 34 and the carrier 47, which may occur, about tilt axes transverse to the rotational axis 5, so that this is not or at most is proportionally transferred to the tool holder 4. In combination with the at least essentially backlash-free mounting of the tool holder 4 on the supporting tube 33, particularly high precision for processing the hollow bodies 55 accommodated on the workpiece rotary table is as a result achieved.

Below, some aspects with regard to the operation of the forming device 1 shall be outlined. In doing so, it is assumed that a plurality of workpiece holders 55, which are arranged in the same division of an angle to the rotational axis 5 and are also referred to as chucks, are attached to the workpiece rotary table 3, in which workpiece holders 55 in each case cup-shaped hollow bodies 56 are accommodated. On the surface of the tool holder 4, opposite the workpiece rotary table 3, corresponding tool holders 57 corresponding to the workpiece holders 55 are arranged, which are equipped with processing tools 58, for example with forming tools.

To put the forming device 1 illustrated in FIG. 1 into operation, firstly the couplings, in particular the flywheel coupling 14 and the indexing unit coupling 21, are brought into a coupled power-transmitting position. In addition, before putting into operation, the eccentric stroke or crank stroke can be set for the connecting rod 7 and the coupling slide 34 coupled to it by relative movement and locking of the outer eccentric 10 with respect to the inner eccentric 9. Moreover, the starting position of the tool holder 4 along the rotational axis 5 can also be set by actuating the servomotor 49 and the spindle nuts 45, 46 coupled to it. Then, the spindle nuts 45, 46 are locked by means of the linear regulating device 46 on the threaded spindle 44.

To put the forming device 1 into operation, the drive motor 11 is supplied with voltage and produces a rotational movement which is conveyed to the flywheel 13 via the belt drive 12. The drive pinion 15, which is connected in a power-transmitting way to the flywheel 13, actuates the main toothed wheel 16. As a result, on the one hand, a crank movement is initiated on the connecting rod 7 by means of the double eccentric arrangement 8. Furthermore, the indexing unit 20 is set in motion via the output toothed wheel 19. When couplings 14, 21 are closed, there is a kinematic forced coupling between the movement of the connecting rod 7, and hence the tool holder 4, and the movement of the indexing unit 20, and hence the workpiece rotary table 3.

By means of the crank movement of the double eccentric arrangement 8 and the coupling via the connecting rod 7, the coupling slide 34 is displaced into an oscillating linear movement, which is transferred via the threaded spindle 44, the spindle nuts 45, 46, the carrier 47 and the coupling means 54 to the tool holder 4 which performs this linear movement in the same way as the coupling slide 34.

The workpiece rotary table 3 is displaced by the indexing unit 20 and the indexing shaft 22 coupled to it, and the indexing pinion 23 and the inner toothing 24, into a rotary step movement about the rotational axis 5. The rotary step movement of the workpiece rotary table 3 and the oscillating linear movement of the tool holder 4 are thereby coordinated in such a way that the workpiece rotary table 3 rests in that time interval in which the processing tools 58 attached to the tool holder 4 are engaged with the hollow bodies 56. The workpiece rotary table 3 performs the rotary step movement if the processing tools 58 are not engaged with the hollow bodies 56. The processing tools 58 can hereby be sequentially brought into engagement with the hollow bodies 56 in the course of the combined linear and rotary step movement of tool holder 4 and workpiece rotary table 3, so that the hollow bodies 56 are formed step by step.

Due to the crank movement of the double eccentric arrangement 8 and the connecting rod 7 coupled to it, considerable gravity forces and oscillations occur during operation of the forming device 1. In order to keep these disturbances away from the hollow bodies 56 and the processing tools 58, at least as far as possible, the supporting side walls 17, which essentially form the second machine frame section 59, are designed dimensionally stable and fixed firmly to the base plate 32, which for its part has a large mass and consequently cannot, or only to a small extent, be displaced by the disturbances. The support plate 26, which supports both the supporting tube 33, for guiding the tool holder 4, and the bearing ring 28, for rotational mounting of the workpiece rotary table 3, is also designed dimensionally stable and is not, or only to a small extent, deformed by the forces occurring during operation of the forming device 1.

In order, on the one hand, to decouple the support plate 26 from the drive device 6 to as large an extent as possible and, on the other hand, to achieve a reliable power flow between support plate 26 and drive device 6, the support plate 26 is connected to the base plate 32 via a flexibly formed coupling area 60. Since, in addition, the support frame 31 has a clearly higher elasticity than the support plate 26, a processing unit 61, formed from support plate 26, workpiece rotary table 3, tool holder 4 and supporting tube 33, can in itself be regarded as a rigid and, as a result, a precise assembly with respect to the processing operation. The processing unit 61 is elastically connected to the base plate 32 via the coupling area 60 and the support frame 31. The movement provided by the connecting rod 7 is conveyed to the processing unit 61 by means of the coupling slide 34 which is slidably accommodated in the supporting tube 33. The coupling means 54 arranged between the coupling slide 34 and the tool holder 4 decouples any tilting movements of the coupling slide 34, so that the tool holder 4 is acted upon with a pure linear movement. Since the tool holder 4 is additionally accommodated on the bearing bars 40 by means of the prestressed, in particular backlash-free, linear guides 42, exact positioning of the processing tools 58 with respect to the hollow bodies 56 is ensured.

A locking device 70 is provided for carrying out relative turning of the inner eccentric 9 with respect to the outer eccentric 10 and for setting the working stroke, which is to be effected as a result and is in particular continuously variable. The locking device 70 comprises a locking lever 71, pivotably mounted on the machine frame 2, a regulating means 72, designed for example as a hydraulically actuatable cylinder, and a locking bolt 73 protruding in the axial direction on the outer eccentric 10.

The outer eccentric 10 can be fixed by means of the locking device 70, by the regulating means 72 being actuated by the control device, which is not illustrated, and the locking lever 71 being pivoted in such a way that the latter can engage with the locking bolt 73. Then, the drive motor 11 is actuated by the control device in such a way that the main toothed wheel 16 carries out a slow rotational movement which in the illustration in FIG. 1 preferably takes place in the clockwise direction. Initially both the inner eccentric 9 and the outer eccentric 10 are moved along with this rotational movement, until the locking bolt 73 engages with the forked locking lever 71. From this point in time, further turning of the outer eccentric 10 is prevented by the pivoted in locking lever 71, while the inner eccentric 9 can turn relative to the outer eccentric 10 when the main toothed wheel 16 rotates further.

The desired setting of the working stroke is brought about by means of this relative turning between inner eccentric 9 and outer eccentric 10. Due to the reduction of the rotational movement between the drive motor 11 and the main toothed wheel 16, a very fine angular resolution can be obtained for the relative movement between the inner eccentric 9 and the outer eccentric 10, so that the working stroke can be practically continuously variably set.

As soon as the desired working stroke between inner eccentric 9 and outer eccentric 10 has been set, the locking bolt 74 can be disengaged from the locking lever 71 by means of a reverse movement of the drive motor 16. Then, the locking lever 71 is brought into a neutral position, which is not illustrated, by means of the regulating means 72 and the forming device 1 can now be operated with the newly set working stroke.

When setting the working stroke, a change to the phase position between cyclical linear movement and rotary step movement can occur. This can be put down to the fact that the upper and the lower dead point of the double eccentric arrangement 8, which result through the position of the two eccentrics 9, 10 in relation to one another, shift during setting relative to the connecting rod 7. Without compensation of the adjusted phase position, a presettable temporal sequence of cyclical linear movement and rotary step movement would no longer be ensured after the stroke has been set. By setting the phase position, the abovementioned temporal sequence can be preset and precisely adapted to the requirements of the processing operation for the hollow bodies.

Figure 2:
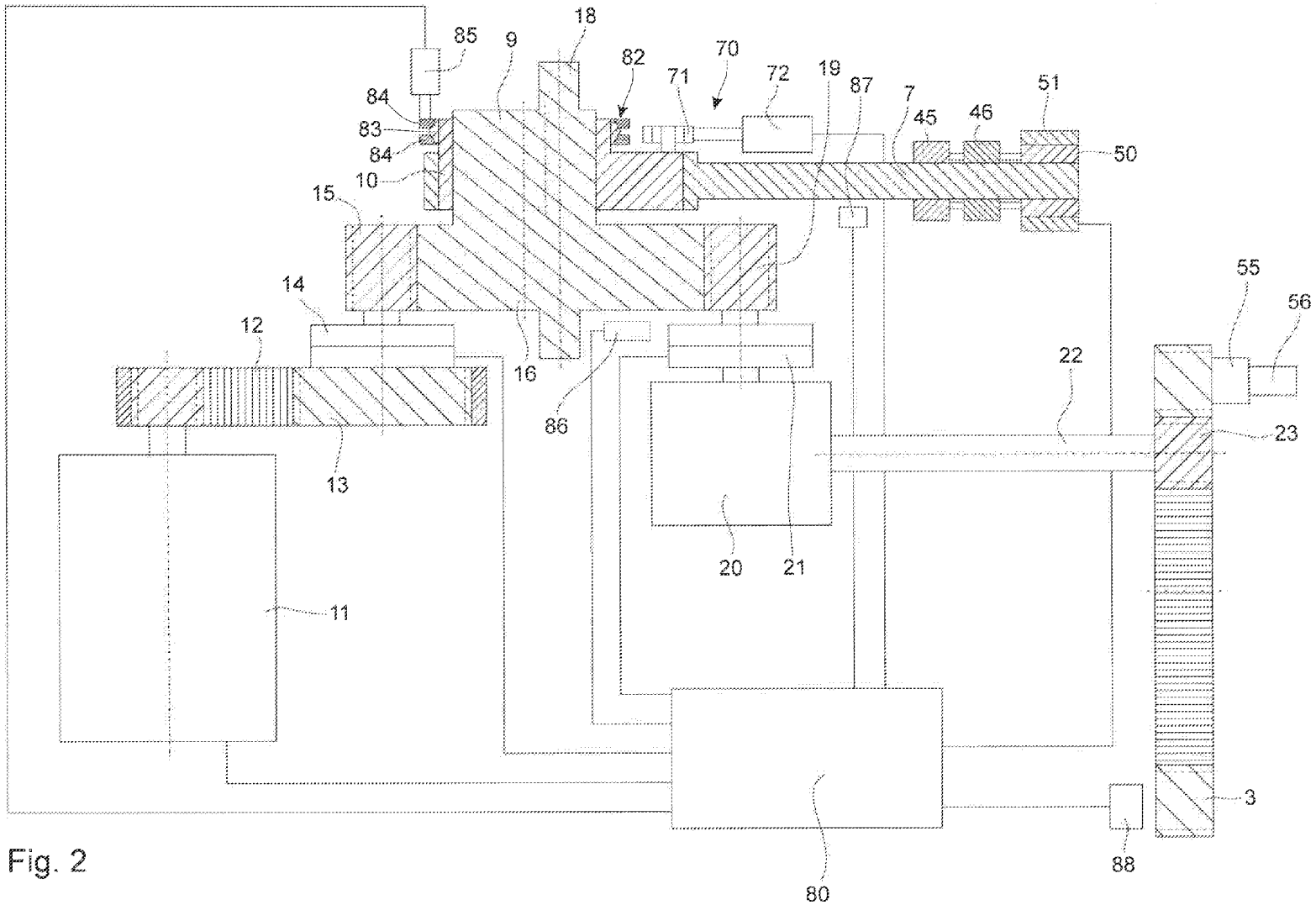
FIG. 2 shows a schematic illustration of the drive device with the first and second drive means.

The setting of the phase position, preferably to be performed continuously variably, between rotary step movement and cyclical linear movement will now be explained with reference to the schematic illustration of FIG. 2. In FIG. 2, for the sake of clarity only the components which are essential for these setting procedures are illustrated from the forming device 1 according to FIG. 1. Some of the components illustrated in FIG. 2 are in turn for the sake of clarity not illustrated in FIG. 1, but form integral elements of the forming device according to FIG. 1.

The drive motor 11 is connected to the flywheel 13 via the belt drive 12 and can convey a rotational movement to the flywheel 13 when correspondingly actuated by means of a control device 80. The flywheel coupling 14 is assigned to the flywheel 13 and can be switched between a decoupled and a power-transmitting position by an internal regulating means which is not illustrated further. The regulating means in the flywheel coupling 14 is connected to the control device 80 for receiving a corresponding switch signal.

The drive pinion 15 is non-rotatably attached to the power take-off side coupling disc (not specified further) of the flywheel coupling 14, which drive pinion 15 meshes with the main toothed wheel 16 and hence enables the rotational movement of the flywheel 13 to be conveyed to the main toothed wheel 16, as long as the flywheel coupling 14 is coupled. The first eccentric 9 is integrally formed onto the main toothed wheel 16 and, additionally, bearing journals 18, which are also integrally formed, are attached to the main toothed wheel 16, which bearing journals 18 are provided for rotationally mounting the main toothed wheel 16 on the supporting side walls 17 which are not illustrated in FIG. 2.

The output toothed wheel 19 meshes with the main toothed wheel 16 and it therefore enables rotational movement to be transferred to the indexing unit coupling 21. In the indexing unit coupling 21, a regulating means (not illustrated further) is integrated which can switch the indexing unit coupling 21 between a decoupled and a power-transmitting position. This regulating means is likewise connected to the control device 80 for receiving a corresponding switch signal.

When the indexing unit coupling 21 is coupled, and hence in power-transmitting mode, the rotational movement of the output toothed wheel 19 can be transferred to the indexing unit 20 which produces a rotary step movement with a presettable angular step size from the continuous rotational movement of the main toothed wheel 16. This rotary step movement is transferred to the workpiece rotary table 3 via the indexing shaft 22 and the indexing pinion 23.

The outer eccentric 10 is rotatably attached to the inner eccentric 9. To non-rotatably fix the outer eccentric 10 to the inner eccentric 9, the outer eccentric 10 has a thin-walled sleeve section 81, on which a clamping set 82, designed as a switchable coupling, is arranged. The clamping set 82 comprises a double cone ring 83, abutting on the circumference of the sleeve section 81, and two clamping rings 84, abutting on the respectively conical outer areas of the double cone ring 83, which clamping rings 84 in each case are formed conically on an inner circumference.

A clamping means 85 is assigned to the clamping set 82, which is equipped to convey axial forces to the two clamping rings 84, in order in the axial direction to bring them closer together or to move them away from one another and hence to enable radial clamping forces to be conveyed to the double cone ring 83 and hence to the sleeve section 81 of the outer eccentric 10. As a consequence, the outer eccentric 10 can optionally be non-rotatably or rotatably mounted on the inner eccentric 9, as a function of a control signal of the control device 80 which acts on the clamping means 85. As has already been stated for FIG. 1, the outer eccentric 10 can be fixed by means of the locking device 70, so as to subsequently make a relative adjustment to the inner eccentric 9 with respect to the outer eccentric 10 and thereby set the working stroke for the connecting rod 7. To detect the relative turning of the two eccentrics 9, 10, an angle of rotation sensor 86 is assigned to the main toothed wheel 16 and the inner eccentric 9 non-rotatably connected to it, the sensor signal of which is transmitted to the control device 80.

The relative turning of the two eccentrics 9, 10 can preferably then be determined if the outer eccentric 10 is fixed by means of the locking device 70, since by this means its rotatory position is also known. The rotatory position of the inner eccentric 9 is determined by the angle of rotation sensor 86. As soon as the desired relative turning between inner eccentric 9 and outer eccentric 10 is obtained, the outer eccentric 10 can be non-rotatably fixed on the inner eccentric 9 by actuating the clamping means 85.

When setting the working stroke by means of the relative turning of the two eccentrics 9, 10 the position of the upper and lower dead point of the double eccentric arrangement 8 with respect to the connecting rod 7 can change. This is accompanied by a change in the phase position of the cyclical linear movement with respect to the indexing unit 20. This, however, according to the processing operation for the hollow bodies 56, is not wanted. Therefore, the phase position between rotary step movement and cyclical linear movement can be corrected after the working stroke has been set.

To correct the phase position, preferably in a continuously variable way, the outer eccentric is initially non-rotatably fixed on the inner eccentric 9 by means of the clamping set 82. The flywheel coupling 14 is closed and the indexing unit coupling 21, in contrast, is opened. The locking device 70 is in the neutral position, so that the rotary movement of the outer eccentric 10 is not hindered. Given these preconditions, the control device 80 can actuate the drive motor 11, in order to bring the connecting rod 7 into the desired position by rotation of the main toothed wheel 16. Due to the reduction of the rotational movement between drive motor 11 and main toothed wheel 16, and with a suitable design of the control device 80, this can be carried out with an angular resolution which enables the phase position between cyclical linear movement and rotary step movement to be set in a practically continuously variable way. To correctly set the phase position, a look-up table or algorithm is stored in the control device 80, with the aid of which, based on the working stroke setting made previously, the phase shift of the cyclical linear movement can be determined with respect to the rotary step movement. The phase position can, additionally, be checked by scanning the rotatory position of the workpiece rotary table 3 by means of the workpiece rotary table sensor 88, which is, for example, an incremental angle of rotation sensor or an inductively working proximity sensor.

To monitor the position of the connecting rod 7, a linear sensor 87 can be additionally provided, the signal of which is supplied to the control device 80 and can be compared there with the signals of the angle of rotation sensor 86.

As soon as the double eccentric arrangement 8 and the connecting rod 7 connected to it have reached the position in which the desired phase position between the first drive means, which are essentially formed by the indexing unit 20, and the second drive means, which are essentially formed by the main toothed wheel 16 with the double eccentric arrangement 8 and the connecting rod 7, is present, the indexing unit coupling unit 21 can be closed again. The forced coupling between the cyclical linear movement and the rotary step movement is hereby restored.

In FIG. 1, a conveyor belt and a loading star assigned to the conveyor belt, for supplying hollow bodies in the tangential direction to a loading position of the workpiece rotary table 3, and a further conveyor belt with an assigned unloading star, for transporting hollow bodies in the tangential direction from an unloading position of the workpiece rotary table 3, and other peripheral devices, as are known from the prior art, are not illustrated.

The invention claimed is:

1. A forming device for cup-shaped hollow bodies, the forming device comprising:

a machine frame;

a workpiece rotary table rotatably supported on the machine frame for accommodating hollow bodies;

a tool holder movably supported on the machine frame for accommodating processing tools, the workpiece rotary table and the tool holder facing one another and the workpiece rotary table being adapted to turn about a rotational axis in relation to the tool holder and the tool holder being adapted to linearly move in relation to the workpiece rotary table along the rotational axis;

a drive motor supported by the machine frame;

an indexing unit connected between the drive motor and the workpiece rotary table for providing a rotary step movement to the workpiece rotary table;

a drive assembly coupled between the drive motor and the tool holder for providing a cyclical linear movement to the tool holder in order to enable the hollow bodies to be formed by means of the processing tools in a plurality of consecutive processing steps, the drive assembly including an inner eccentric shaft connected to the drive motor, an outer eccentric bush receiving the inner eccentric shaft, a connecting rod coupled between the outer eccentric bush and the tool holder;

a locking device coupled between the machine frame and the drive assembly for rotatably adjusting the outer eccentric bush with respect to the inner eccentric shaft thereby changing a working stroke of the cyclical linear movement of the tool holder; and a control device for actuating the locking device for continuously variably adjusting the working stroke.

2. A forming device according to claim 1, wherein the locking device is coupled to the control device, in order to ensure that the phase position is continuously variably set based on a control signal of the control device.

3. A forming device according to claim 1, wherein the locking device can be adjusted between a release position and an engagement position for fixing the outer eccentric bush with respect to the inner eccentric shaft.

4. A forming device according to claim 1, wherein a sensor device for determining the respective rotatory position, which is connected to the control device, is assigned to the inner eccentric shaft.

5. A forming device according to claim 1, wherein a look-up table is stored in the control device, in which a correction value for the phase position between the rotary step movement and the cyclical linear movement is assigned to each position of the outer eccentric bush with respect to the inner eccentric shaft.

6. A forming device according to claim 1, wherein the inner eccentric shaft is non-rotatably connected to a gear wheel, the gear wheel being connected to the drive motor.

7. A forming device according to claim 1, wherein the locking device is designed for engaging with the outer eccentric bush.

8. A forming device according claim 1, wherein the indexing unit comprises a regulating means designed for actuating by the control device and which optionally enable the indexing unit to be opened or closed, a rotational movement from the inner eccentric shaft being transferred to the indexing unit when the indexing unit is closed for providing the rotary step movement to the workpiece rotary table, and the rotational movement not being transferred when the indexing unit is opened.

9. A forming device according to claim 1, wherein the locking device comprises a clamping set having at least two clamping rings, wherein adjoining clamping rings have cone surfaces designed corresponding to one another.

10. A forming device according to claim 1, wherein the outer eccentric bush comprises a locking bolt protruding in an axial direction, and the locking device comprises a locking lever pivotably mounted on the machine frame and an actuatable cylinder coupled to the locking lever, the actuatable cylinder being actuated by the control device to alternately engage and disengage the locking lever of the locking device with the locking bolt of the outer eccentric bush for rotatably adjusting the outer eccentric bush with respect to the inner eccentric shaft.

11. A forming device according to claim 1, wherein the indexing unit comprises an indexing unit coupling, an output toothed wheel connected between the indexing unit coupling and the inner eccentric shaft, an indexing pinion coupled to the workpiece rotary table and an indexing shaft coupled between the indexing unit coupling and the indexing pinion for providing a rotary step movement to the workpiece rotary table.

12. A forming device according to claim 11, wherein the indexing unit is switchable between a coupled and a decoupled position, the output toothed wheel transferring a rotational movement from the inner eccentric shaft to the indexing unit coupling when the indexing unit is in said coupled position for providing the rotary step movement to the workpiece rotary table, the rotational movement not being transferred when the indexing unit is in said decoupled state.

13. A forming device for cup-shaped hollow bodies, the forming device comprising:

a machine frame;

a workpiece rotary table rotatably supported on the machine frame for accommodating hollow bodies;

a tool holder movably supported on the machine frame for accommodating processing tools, the workpiece rotary table and the tool holder facing one another and the workpiece rotary table being adapted to turn about a rotational axis in relation to the tool holder and the tool holder being adapted to linearly move in relation to the workpiece rotary table along the rotational axis;

a servo drive supported by the machine frame for electrically providing a rotary step movement to the workpiece rotary table;

a drive motor supported by the machine frame for providing a cyclical linear movement to the tool holder in order to enable the hollow bodies to be formed by means of the processing tools in a plurality of consecutive processing steps;

an inner eccentric shaft connected to the drive motor;

an outer eccentric bush receiving the inner eccentric shaft;

a connecting rod coupled between the outer eccentric bush and the tool holder;

a locking device coupled between the machine frame and the outer eccentric bush for rotatably adjusting the outer eccentric bush with respect to the inner eccentric shaft thereby changing a working stroke of the cyclical linear movement of the tool holder; and a control device for actuating the locking device for continuously variably adjusting the working stroke.

14. A forming device according to claim 13, wherein the outer eccentric bush comprises a locking bolt protruding in an axial direction, and the locking device comprises a locking lever pivotably mounted on the machine frame and an actuatable cylinder coupled to the locking lever, the actuatable cylinder being actuated by the control device to alternately engage and disengage the locking lever of the locking device with the locking bolt of the outer eccentric bush for rotatably adjusting the outer eccentric bush with respect to the inner eccentric shaft.

* * * * *